US005318415A

United States Patent [19]

Verhoeven

[11] Patent Number: 5,318,415

[45] Date of Patent: Jun. 7, 1994

[54] GROOVED PUMP CHAMBER WALLS FOR FLUSHING FIBER DEPOSITS

[75] Inventor: Nicholas Verhoeven, Pierrefonds, Canada

[73] Assignee: Gramprotex Holdings Inc., Pointe-Claire, Canada

[21] Appl. No.: 955,960

[22] Filed: Oct. 2, 1992

[51] Int. Cl.[5] ..... F01C 21/00

[52] U.S. Cl. ..... 418/46; 418/79

[58] Field of Search ..... 418/46, 75, 79

[56] References Cited

U.S. PATENT DOCUMENTS

| | | | |
|---|---|---|---|
| 1,348,771 | 8/1920 | Auger | 418/46 |
| 1,348,772 | 8/1920 | Auger | 418/46 |
| 1,348,773 | 8/1920 | Auger | 418/46 |
| 2,878,757 | 3/1959 | Marco | 418/133 |
| 4,225,296 | 9/1980 | Haupt | 418/39 |
| 4,400,146 | 8/1983 | Dworak et al. | 418/131 |
| 4,462,770 | 7/1984 | Haupt | 418/39 |
| 4,645,439 | 2/1987 | Way | 418/104 |

FOREIGN PATENT DOCUMENTS

| | | |
|---|---|---|
| 939307 | 1/1974 | Canada . |
| 950267 | 7/1974 | Canada . |
| 951176 | 7/1974 | Canada . |
| 971424 | 7/1975 | Canada . |
| 971483 | 7/1975 | Canada . |
| 991481 | of 1976 | Canada . |
| 982409 | 1/1976 | Canada . |
| 1016870 | of 1977 | Canada . |
| 1036130 | of 1978 | Canada . |
| 1086277 | of 1980 | Canada . |
| 1112224 | of 1981 | Canada . |
| 1237601 | of 1988 | Canada . |
| 1258275 | of 1989 | Canada . |

*Primary Examiner*—Richard A. Bertsch
*Assistant Examiner*—Charles G. Freay
*Attorney, Agent, or Firm*—Merchant, Gould, Smith, Edell, Welter & Schmidt

[57] ABSTRACT

A rotary lobe pump has a pair of rotary lobes rotatably mounted in a pump chamber having end walls perpendicular to axes of the lobes and a side wall with which the rotors making sealing contact. At least one of the end walls is provided with a shallow groove in a region between the axes, the groove being of a selected depth and width to permit solid material lodged between the rotors and at least one of the end walls to become disengaged and flushed out while allowing a minimum of fluid to flow through the groove causing pressure loss in the pump.

4 Claims, 4 Drawing Sheets

GROOVED PUMP CHAMBER WALLS FOR FLUSHING FIBER DEPOSITS

FIELD OF THE INVENTION

The present invention relates to a rotary lobe pump having grooved pump chamber walls for flushing fiber deposits.

BACKGROUND OF THE INVENTION

Rotary lobe pumps are well known industrial pumps which have been in common use for about forty years. A pair of counterrotating interlocking lobe rotors in a pump chamber draw fluid from an input port and expel the fluid through an output port. The pump is well suited to low velocity, high density fluid, especially sludge-like fluid. Examples of applications are chemical slurries, milk and sewage.

In operating environments where the pump is subjected to non-uniform material or fluid to be pumped, maintenance requirements increase substantially. For example, when pumping waste material, pieces of solid matter can be mixed in and get caught in the pump. When this happens, the pump is jammed and will stop as a result of the pump drive motor overload protection circuit. Once the pump has been jammed, the jamming object must be removed and the pump must be restarted. Also, certain waste products are especially harmful either to the rotor material (usually surfaced with rubber) or the seals around the rotor drive shafts. Caustic substances and precipitous liquid are examples of substances which are harmful to the seals, and fibrous material, such as paper pulp in municipal sewers, is an example of a substance which is damaging to the rotor surfaces, as well as the pump chamber.

SUMMARY OF THE INVENTION

It is an object of the present invention to provide a rotary lobe pump which does not lock up or wear out when pumping emulsions of solid material, such as paper pulp.

According to a first aspect of the invention, there is provided a rotary lobe pump comprising a pump chamber having input and output ports provided in a side wall of the chamber and a pair of elastomer coated rotary lobes rotatably mounted in the chamber. The rotors have parallel axes of rotation, the pump chamber also has end walls perpendicular to the axes and the side wall, the rotors making continuous rolling sealing contact with each other and sliding sealing contact with the end walls and the side wall. At least one of the end walls is provided with a shallow groove in a region between the axes. The groove is centered about a middle axis extending between the parallel axes of rotation. The groove is of a selected depth and width to allow fluid flow from a high pressure output side of said groove to a low pressure input side of said groove to cause alternating circulation in said groove transversely and lengthwise with respect to said middle axis to permit solid fibrous material lodged in a boundary layer between the rotors and the at least one of the end walls to become disengaged and flushed out while allowing a minimum of fluid to flow through the groove causing pressure loss in the pump.

BRIEF DESCRIPTION OF THE DRAWINGS

The invention will become better understood by way of the following description a preferred embodiment with reference to the appended drawings in which.

DETAILED DESCRIPTION OF THE PREFERRED EMBODIMENT

Figure 1:
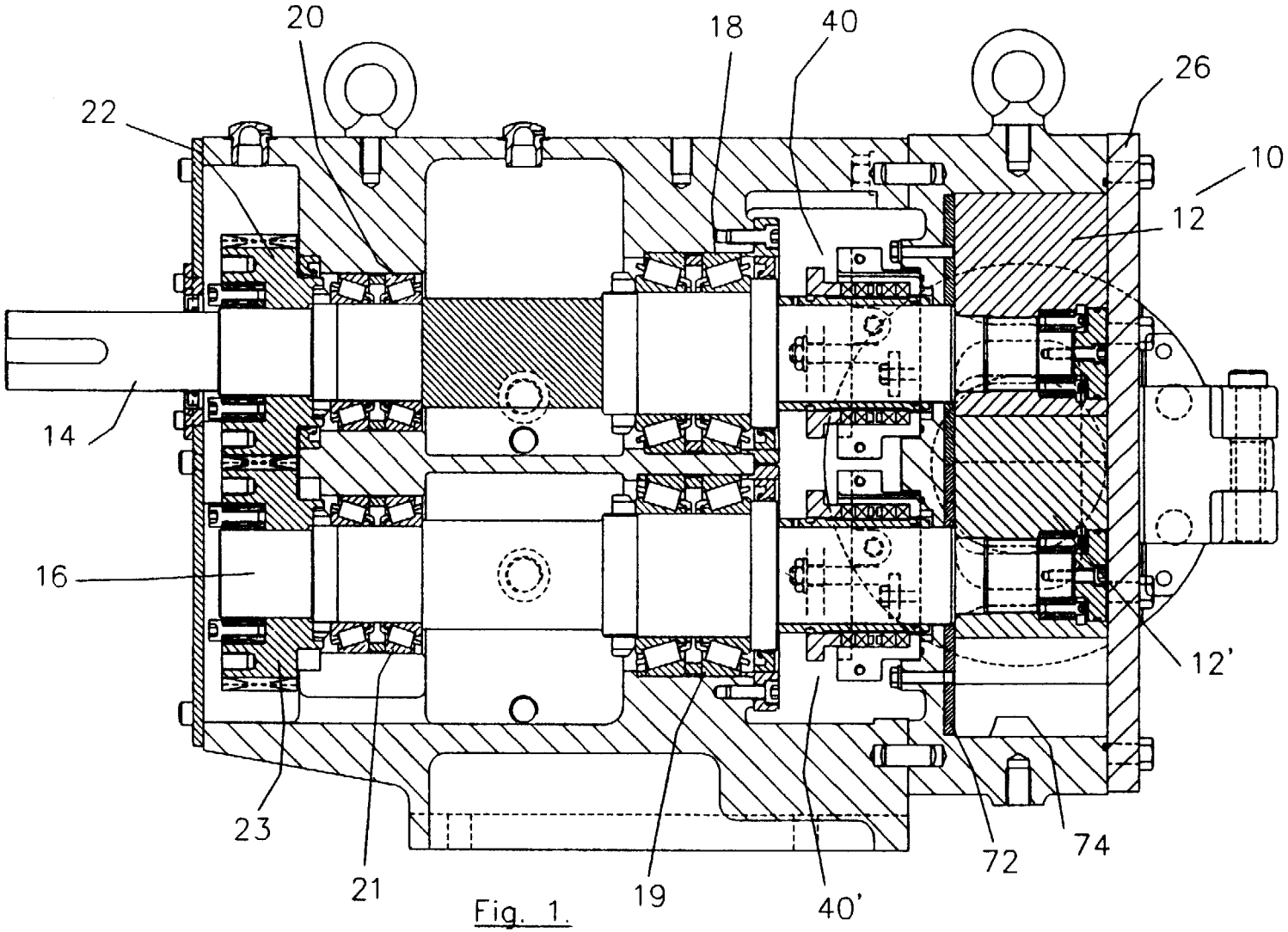
FIG. 1 is a side cross-section of a rotary lobe pump according to the preferred embodiment.

In the preferred embodiment, as shown in FIG. 1, a pump (10) has a pump chamber (15) housing the lobe rotors (12,12'), a removable front cover plate (26) on a front end of the pump chamber (15) for allowing access thereto, a main drive shaft (14) connected to a first one of the rotors (12), a second shaft (16) driven by the drive shaft (14) via timing gears (22,23) and connected to a second one of the rotors (12'), and durable seals (40,40') sealing the shafts (14,16) to the pump chamber (15).

The pumping action of pump (10) is created by the lobes (12,12') interlocking and turning at the same speed while maintaining the same relative phase angle. The rotors (12,12') are rubber coated and make sliding sealing contact with side wall (74) and the end walls, namely the cover plate (26) and the wear plate (72). The shafts (14,16) are well interconnected by the timing gears (22,23) and bearings (18,19) are provided as close to the seals (40,40') as possible so that bearings (18,19) along with rear bearings (20,21) rotatably mount the shafts in pump casing (11) with the rotors (12,12') are mounted at the ends or the shafts, such that the rotors resist displacement even when subjected to the various forces during pumping.

Figure 2:
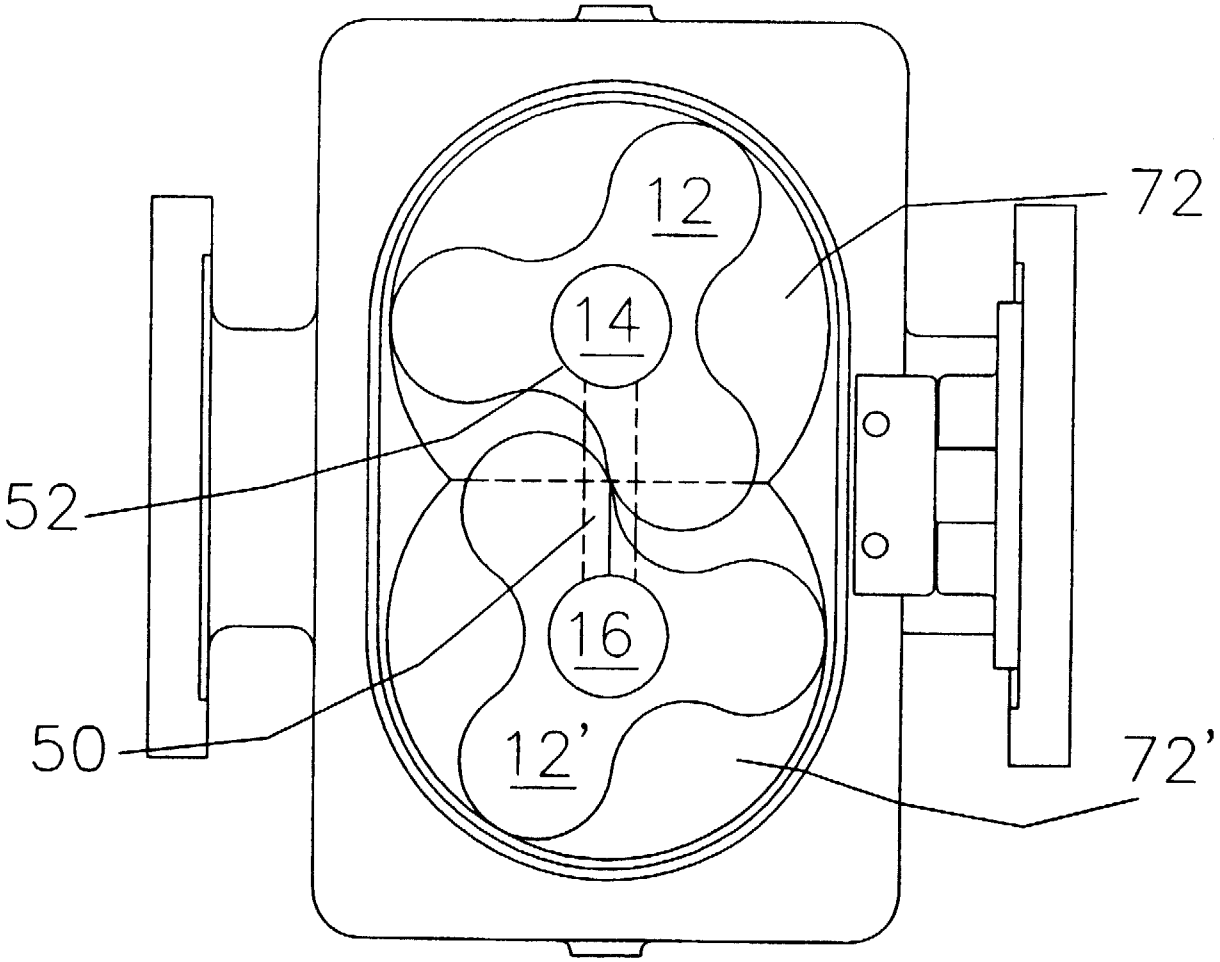
FIG. 2 is an end view of a rotary lobe pump chamber.

As shown in FIG. 2, the pumping action of rotors (12,12') is created by rotating the top rotor (12) clockwise, and the bottom rotor (12') counterclockwise. Due to the shape of the rotors, there is continuous rolling sealing contact made between the rotors as they turn, and each rotor makes sliding sealing contact with side wall (74).

In FIG. 2, there is shown where a groove (50) is placed on wear plates (72,72'). Although another groove (50) could be placed on the front cover plate (26), in the preferred embodiment there is only one flushing groove provided, namely of the wear plates (72,72'). Since the left side of the pump (10) shown in FIG. 2 is the inlet side and the right side is the outlet side, there is a pressure differential between the two sides of groove (50). As a result, fluid flows from the high pressure side of the groove to the low pressure side to cause alternating circulation in the groove transversely and lengthwise with respect to the middle axis extending between the parallel axes of rotation. This pressure differential is used to force out fibrous material wedged between the rotors (12,12') and the wear plates (72,72').

Figure 3:
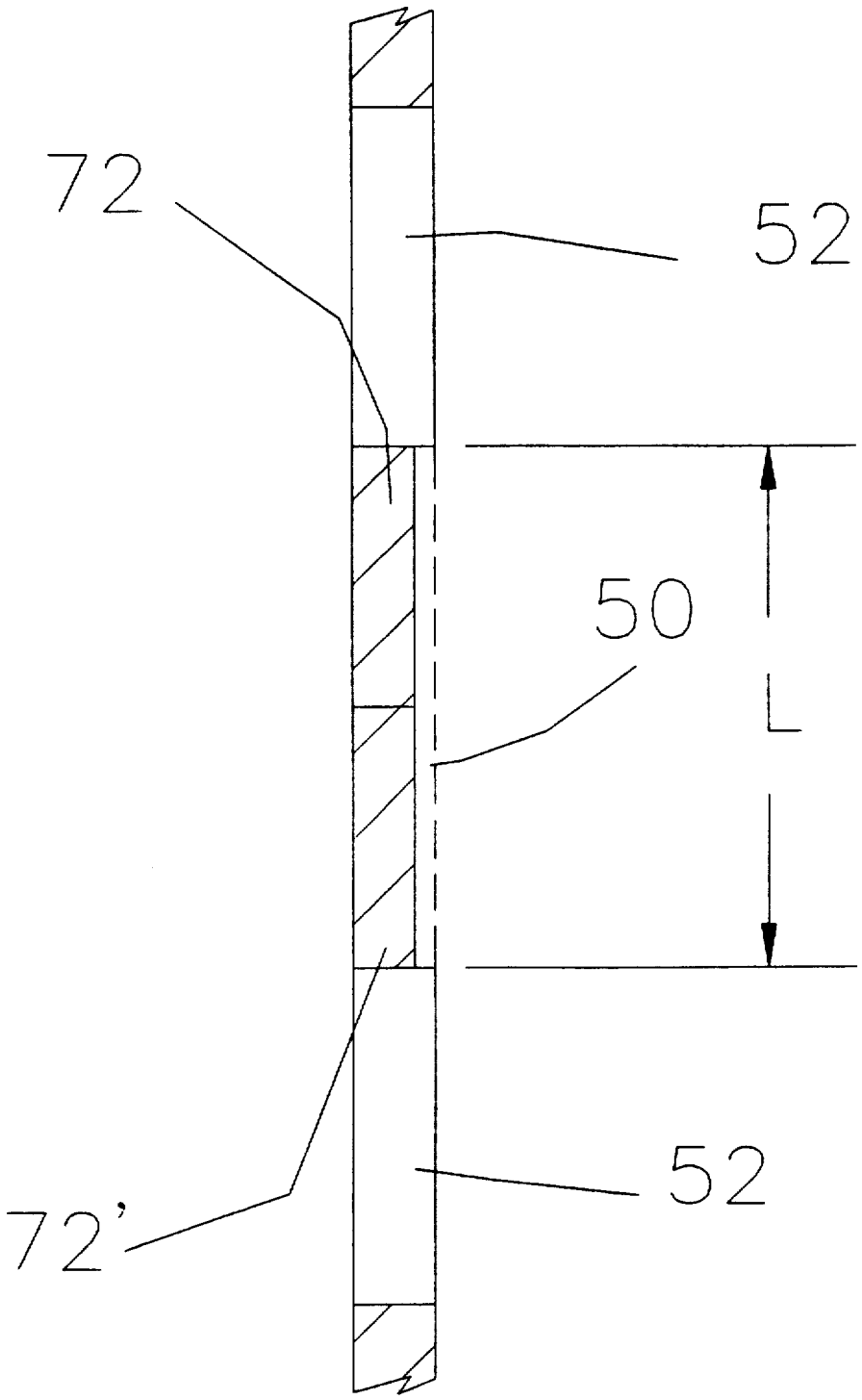
FIG. 3 is a vertical cross section of the wear plates.
Figure 4:
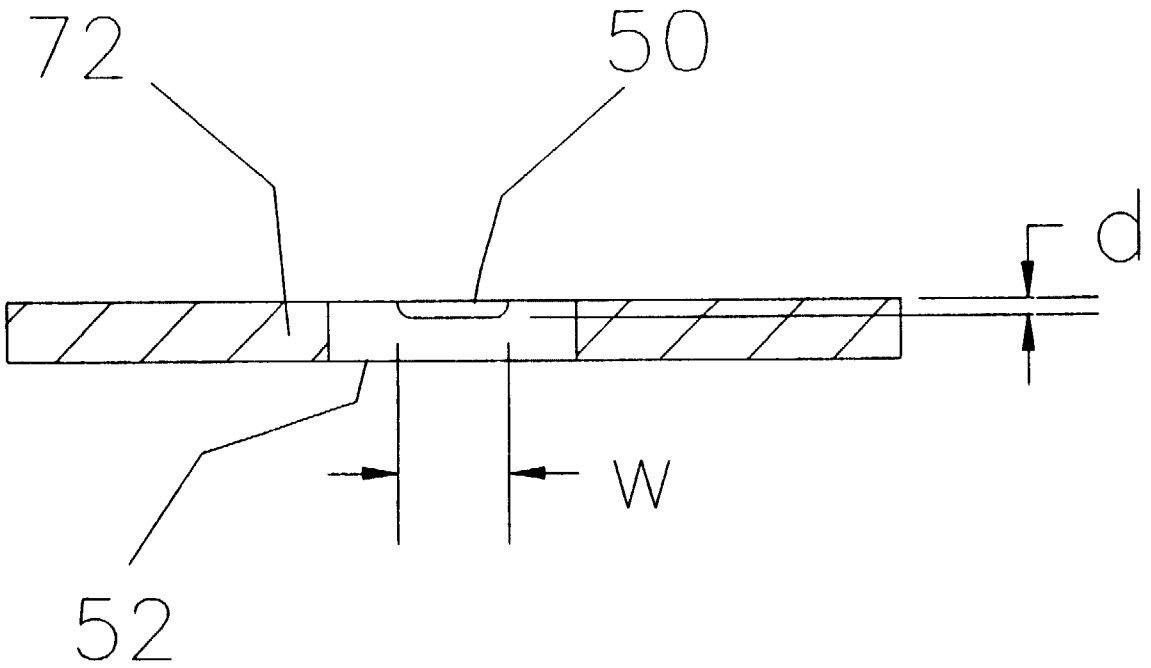
FIG. 4 is a horizontal cross section of one wear plate.

FIGS. 3 and 4 illustrate the preferred shape of groove (50). Each wear plate (72,72') has a hole (52) through which shafts (14,16) pass. The groove (50) extend between the holes (52) with the vertical ends of the groove extending through to the holes (52), although it is possible that the ends stop short of the holes (52). When the rotors are about 20 cm in diameter, the groove (50) is about 3 cm in width 'w'. The groove is about 0.5 mm in depth 'd'. The groove (50) is tapered or rounded at its sides in the length 'w'. Groove (50) can also be ground into the plates (72,72') by a grinding wheel having a diameter of about 20 cm to give the widthwise cross section a rounded profile. The choice of groove curvature or profile can be selected as required to provide good flushing characteristics, with a minimum of pump pressure loss due to fluid passing through the groove.

It is to be understood that the above detailed description is not intended to limit the scope of the present invention as defined in the appended claims.

What is claimed is:

1. A rotary lobe pump comprising:

a pump chamber having input and output ports provided in a side wall of the chamber; and a pair of elastomer coated rotor rotatably mounted in said chamber, the rotors having parallel axes of rotation, the pump chamber also having end walls perpendicular to said axes and said side wall, said rotors making continuous rolling sealing contact with each other and sliding sealing contact with said end walls and said side wall; wherein:

at least one of said end walls is provided with a shallow groove in a region between said axes, said groove being centered about a middle axes extending between said parallel axes, said groove being of a selected depth and width to allow fluid flow from a high pressure output side of said groove to a low pressure input side of said groove to cause alternating circulation in said groove transversely and lengthwise with respect to said middle axis to permit solid fibrous material lodged in a boundary layer between said rotors and said at least one of said end walls to become disengaged and flushed out while allowing a minimum of fluid to flow through said groove causing pressure loss in said pump.

2. Rotary lobe pump as claimed in claim 1, wherein said groove is about 0.5 mm deep.

3. Rotary lobe pump as claimed in claim 1, wherein said groove is provided on a given one of said end walls where drive shafts for turning said lobes pass through.

4. Rotary lobe pump as claimed in claim 3, wherein said groove extends substantially completely between said drive shafts.

* * * * *